United States Patent [19]

Boer et al.

[11] 4,110,906

[45] Sep. 5, 1978

[54] SHAVING HEAD FOR A DRY-SHAVING APPARATUS

[75] Inventors: Melle Boer; Albertus Pieter Rentema, both of Drachten, Netherlands

[73] Assignee: U.S. Philips Corporation, New York, N.Y.

[21] Appl. No.: 805,709

[22] Filed: Jun. 13, 1977

[30] Foreign Application Priority Data

Jul. 7, 1976 [NL] Netherlands ..... 7607476

[51] Int. Cl.[2] ..... B26B 19/04

[52] U.S. Cl. ..... 30/43.92; 30/346.51

[58] Field of Search ..... 30/43.4, 43.5, 43.6, 30/43.7, 43.8, 43.9, 43.91, 43.92, 346.51

[56] References Cited

U.S. PATENT DOCUMENTS

| | | | |
|---|---|---|---|
| 3,271,854 | 9/1966 | Starre | 30/346.51 X |
| 3,456,341 | 7/1964 | Loner | 30/43.92 X |
| 3,855,697 | 12/1974 | Meyer | 30/43.92 X |
| 3,967,374 | 7/1976 | Boiten | 30/43.92 |
| 4,003,131 | 1/1977 | Groothuis | 30/43.92 |

*Primary Examiner*—Gary L. Smith

*Attorney, Agent, or Firm*—Frank R. Trifari; Rolf E. Schneider

[57] ABSTRACT

A detachable shaving head for a reciprocatory dry-shaving apparatus having a carrying frame hinged to the head cap and provided with a cutting assembly, the carrying frame having on its under side an oblique surface whose height decreases inwardly from the hinged edge of the carrying frame, a stop cam being provided on such under side adjacent the inner end of the oblique surface for cooperation with an edge of the cap.

1 Claim, 3 Drawing Figures

SHAVING HEAD FOR A DRY-SHAVING APPARATUS

Figure 1:
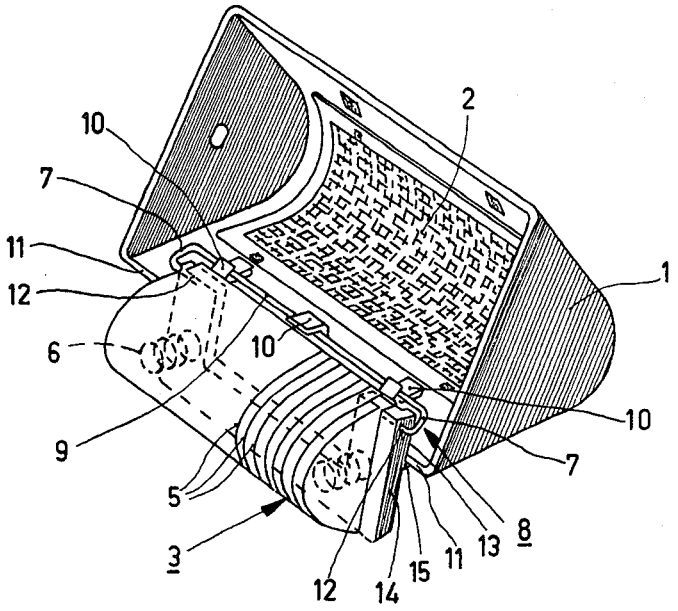

This invention relates to a detachable shaving head for a reciprocatory dry-shaving apparatus, comprising a cap, a flexible shear plate which is mounted in the cap, and a carrying frame which is hingeably connected to the cap by means of hinge arms, on which frame there is mounted a cutting assembly provided with a plurality of shaving cutters for co-operation with the shear plate, said hinge arms being hingeably connected to one side of the carrying frame by one of their ends and to the inner wall of the cap at their other ends.

Such a shaving apparatus is known from Patent Application No. 3,967,374. When in this shaving apparatus the carrying frame with its cutting assembly has been hinged out of the cap in order to clean the shaving cutters, the hinge arms bear on an edge of the cap. The distance between the bearing arrangements of the arms in the cap to the edge of the cap is then much smaller than the distance between the bearing arrangements of the arms in the carrying frame to the edge of the cap. This has the disadvantage that when the shaving cutters are brushed clean the hinge arms and the bearing arrangements of the hinge arms are likely to be damaged owing to the unfavourable lever ratio. In practice the hinge arms are so short that in the hinged-out condition the carrying frame bears on the edge of the cap. However, this results in a similar unfavourable situation during cleaning.

It is an object of the invention to eliminate this drawback and the invention is therefore characterized in that at the side which faces away from the shaving cutters the carrying frame has at least one oblique surface, whose height decreases inwardly from the edge of the carrying frame, a stop cam being provided adjacent the inner end of the oblique surface for co-operation with an edge of the cap.

In the hinged-out condition the carrying frame now slides on its oblique surface over the edge of the cap up to the stop cam. In this situation the lever ratio is far more favourable, so that it is not likely to give rise to damage.

Figure 2:
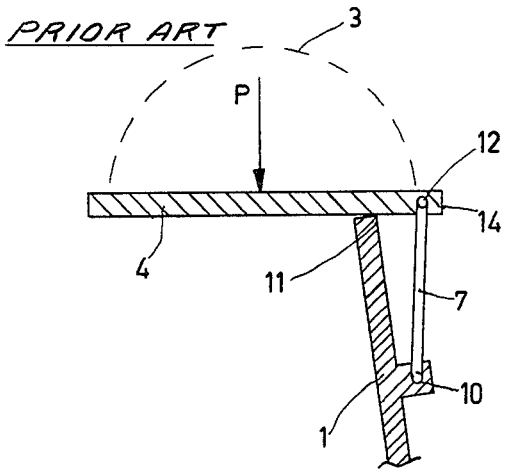
Figure 3:
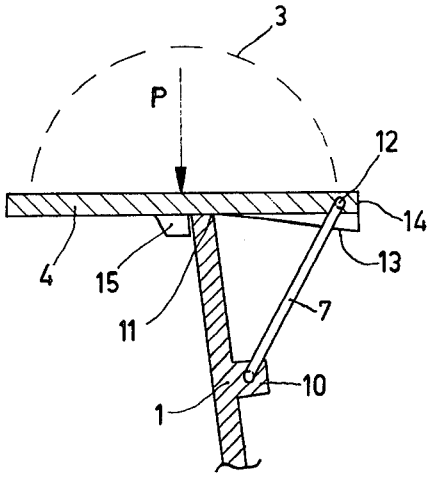

The invention will now be described in more detail with reference to the embodiment shown in the drawings, in which:

FIG. 1 is a perspective view of the detachable shaving head, the carrying frame with the cutting assembly mounted on it being hinged out of the cap, FIG. 2 schematically represents on an enlarged scale the situation near the edge of the cap in the prior-art version of the shaving head, and FIG. 3 schematically represents on an enlarged scale the situation near the edge of the cap in the case of a shaving head in accordance with the invention.

The shaving head of a reciprocatory shaving apparatus in accordance with FIG. 1 comprises a cap 1, in which an arcuate shear plate 2 in which hair entrance apertures are formed is detachably secured. A cutting assembly 3 is urged into engagement with the underside of the arcuate shear plate 2. The cutting assembly 3 has a plurality of shaving cutters 5 whose arcuate cutting edges in respect to their shape correspond to the curvature of the shear plate 2. The cutting assembly 3 is connected to a carrying frame 4. The cutting assembly 3 is urged against the underside of the shear plate 2 by means of two pressure springs 6. The carrying frame 4 can be latched in the cap in its operating position with the aid of latching means, which comprises two hinge arms 7 hingeably connected to one side of the carrying frame 4 and to the inner wall of the cap 1. Furthermore, the carrying frame 4 at its side which faces the hinge arms 7, is provided with latching cams which cooperate with corresponding recesses in the inner wall of the cap 1. The hinge arms are constituted by limbs of a substantially U-shaped bracket 8 made of metal wire, whose portion 9 is hingeably journalled on the inside of the cap 1 with the aid of bearing cams 10.

FIG. 2 represents the situation near the edge 11 of the cap 1 for the prior-art shaving apparatus when the cutting assembly 3 is completely hinged out of the cap 1. The arrow P indicates the force which is exerted on the carrying frame 4 when the shaving cutters 5 are brushed clean. As in this situation the distance between the edge 11 and the bearing arrangement 12 is substantially smaller than the distance between the edge 11 and the point of application of the force P, substantial forces are exerted on the hinge arms 7 and the bearing arrangements 10 and 12 and also on the edge 11 owing to an unfavourable lever ratio, which forces do damage.

FIG. 3 represents the situation in accordance with the invention. On its underside the carrying frame 4 is provided with at least one oblique surface 13, whose height from the edge 14 of the carrying frame 4 decreases inwardly and which terminates at a cam stop 15. When the cutting assembly 3 is hinged out of the cap, the carrying frame 4 slides over the oblique surface 13 along the edge 11 of the cap towards the stop cam 15. In this situation, in which the lever ratio is far more favourable, the forces produced during cleaning of the shaving cutters will be substantially smaller and the risk of damage is thus substantially reduced. Preferably, such oblique surfaces with stop cams are provided at two locations on the underside of the carrying frame 4.

What is claimed is:

1. A detachable shaving head for a reciprocatory dry-shaving apparatus, which comprises a cap, a flexible shear plate mounted in the cap, a carrying frame hingeably connected to the cap by means of hinge arms, a cutting assembly mounted on the upper side of said carrying frame and provided with a plurality of shaving cutters for co-operation with the shear plate, each hinge arm being hingeably connected to one side of the carrying frame by one of its ends and to the inner wall of the cap at its other end, the underside of the carrying frame having at least one oblique surface whose height decreases inwardly from the edge of the carrying frame, and a stop cam provided on such under side adjacent the inner end of the oblique surface for cooperation with an edge of the cap.

* * * * *